US011773814B2

(12) United States Patent
Harada et al.

(10) Patent No.: US 11,773,814 B2
(45) Date of Patent: Oct. 3, 2023

(54) AIR INTAKE PASSAGE STRUCTURE

(71) Applicant: HONDA MOTOR CO., LTD., Tokyo (JP)

(72) Inventors: Yoshihiro Harada, Wako (JP); Tsuyoshi Yoshigasaki, Wako (JP); Yuki Hase, Wako (JP); Hiroshi Yamamoto, Wako (JP); Shogo Yoneyama, Wako (JP); Ayaka Yamamoto, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 17/583,960

(22) Filed: Jan. 25, 2022

(65) Prior Publication Data

US 2022/0275777 A1 Sep. 1, 2022

(30) Foreign Application Priority Data

Feb. 26, 2021 (JP) ..... 2021-030597

(51) Int. Cl.
*F02M 35/16* (2006.01)

(52) U.S. Cl.
CPC ..... *F02M 35/167* (2013.01)

(58) Field of Classification Search
CPC ..... F02M 35/167
See application file for complete search history.

(56) References Cited

U.S. PATENT DOCUMENTS 9,359,981 B1 * 6/2016 Waisanen ..... F02M 35/167
2014/0141665 A1 5/2014 Harada et al.

FOREIGN PATENT DOCUMENTS

JP 2013-23117 A 2/2013

* cited by examiner

*Primary Examiner* — Jacob M Amick
*Assistant Examiner* — Charles J Brauch
(74) *Attorney, Agent, or Firm* — WHDA, LLP

(57) ABSTRACT

An air intake passage structure includes an outer cover forming an outer wall of an outboard motor, an inner cover disposed inside the outer cover, a first intake port formed in the outer cover, a second intake port formed in the inner cover, an air introduction chamber formed between the outer cover and the inner cover; and an air passage formed inside the outer cover. The air passage includes a first passage part on an upper side of the air introduction chamber, and a second passage part extending downward from the first passage part. The air introduction chamber includes a side portion communicating with the first intake port, and a top portion communicating with the first passage part through an opening formed in the partition wall.

8 Claims, 7 Drawing Sheets

AIR INTAKE PASSAGE STRUCTURE

CROSS-REFERENCE TO RELATED APPLICATION(S)

This application claims priority to and the benefit of Japanese Patent Application No. 2021-030597, filed on Feb. 26, 2021, the entire disclosure of which is incorporated herein by reference.

BACKGROUND OF THE INVENTION

Field of the Invention

The present invention relates to an air intake passage structure of an engine in an outboard motor.

Description of the Related Art

Engines for outboard motors are used on water, and therefore intake air may contain water droplets. The water droplets cause performance degradation and deterioration of the engine. An outboard motor having a structure for separating moisture in a process in which air flows from the outside of the outboard motor into the engine has been proposed (Japanese Patent Laid-Open No. 2013-23117 A and the like).

In the separation of the moisture in the intake air, generally, a wall portion is provided in the air intake passage, and the intake air is applied to the wall portion so that the moisture is separated. However, when the flow velocity of the intake air increases, the moisture may pass over the wall portion.

SUMMARY OF THE INVENTION

An object of the present invention is to provide an air intake passage structure capable of more reliably separating moisture in intake air.

According to one aspect of the present invention, there is provided an air intake passage structure comprising: an outer cover forming an outer wall of an outboard motor; an inner cover disposed inside the outer cover, and covering an engine of the outboard motor; a first intake port formed in the outer cover; a second intake port formed in the inner cover, air being supplied to the engine via the first intake port and the second intake port; an air introduction chamber formed between the outer cover and the inner cover, and communicating with the first intake port; and an air passage formed inside the outer cover, and guiding the air from the air introduction chamber to the second intake port, wherein the air passage is adjacent to the air introduction chamber via a partition wall, the air passage includes: a first passage part on an upper side of the air introduction chamber; and a second passage part extending downward from the first passage part, and the air introduction chamber includes: a side portion communicating with the first intake port; and a top portion communicating with the first passage part through an opening formed in the partition wall.

Further features of the present invention will become apparent from the following description of exemplary embodiments (with reference to the attached drawings).

DESCRIPTION OF THE EMBODIMENTS

Figure 1:
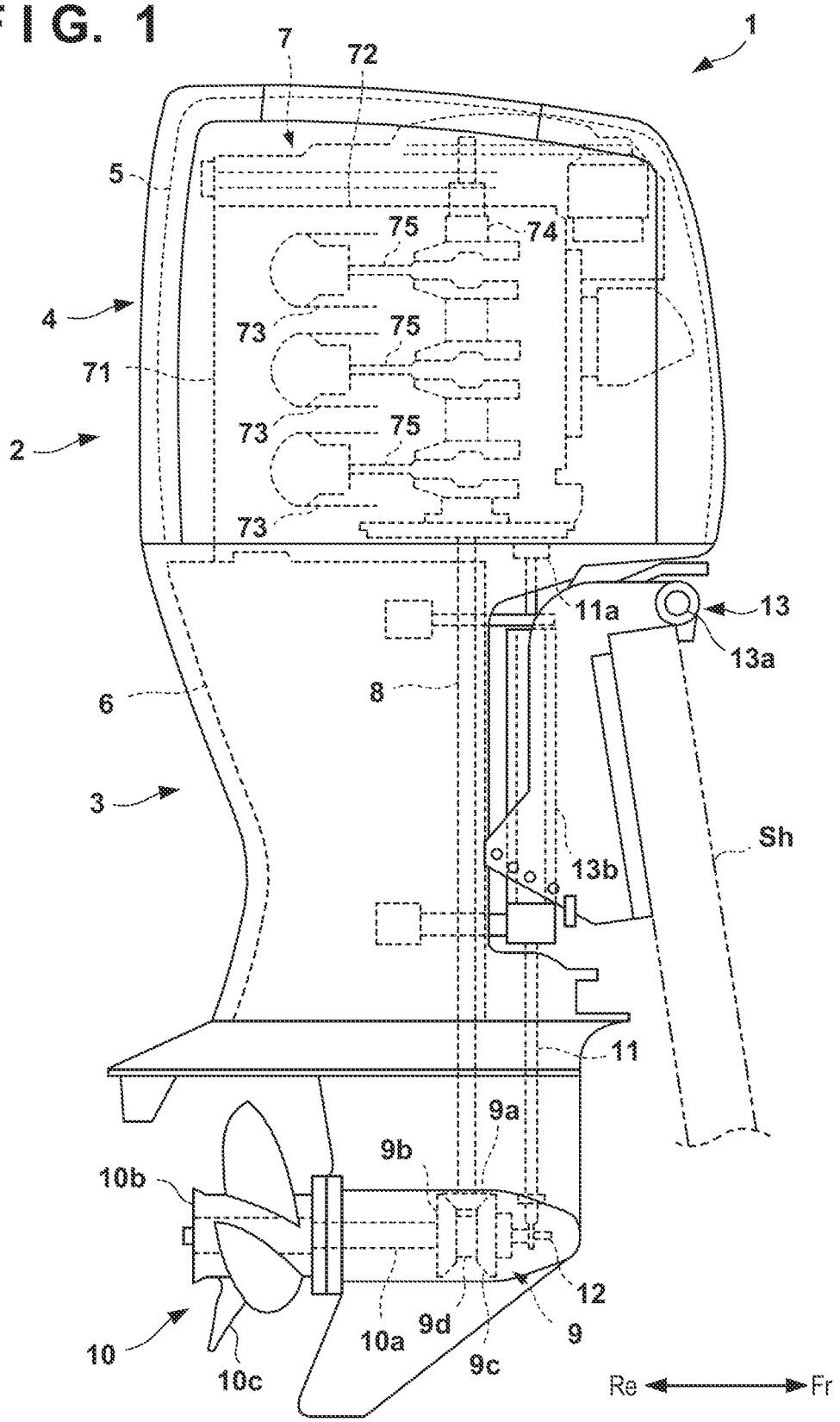
FIG. 1 is a side view illustrating an overall configuration of an outboard motor.

Hereinafter, embodiments will be described in detail with reference to the attached drawings. Note that the following embodiments are not intended to limit the scope of the claimed invention, and limitation is not made an invention that requires all combinations of features described in the embodiments. Two or more of the multiple features described in the embodiments may be combined as appropriate. Furthermore, the same reference numerals are given to the same or similar configurations, and redundant description thereof is omitted.

FIG. 1 is a side view of an outboard motor 1 including an air intake passage structure according to an embodiment of the present invention. The outboard motor 1 is attached to a hull Sh, as a power source of a small vessel or the like, and is driven by an operation by a user to propel the hull Sh. Note that, in each drawing, Fr represents a front side in a front-and-rear direction of the outboard motor 1, Re represents a rear side, L represents a left side in a forward direction of the outboard motor 1, and R represents a right side. In describing a direction of the outboard motor 1, the direction means an orientation when the outboard motor 1 is mounted on the hull Sh (particularly, the posture at the time of operation when a crankshaft 74 is oriented in an up-and-down direction as illustrated in FIG. 1).

The outboard motor 1 is fixed to the hull Sh via a mounting mechanism 13. The mounting mechanism 13 enables the outboard motor 1 to swing about a swivel shaft 13*b*, and enables the outboard motor 1 to swing clockwise or counterclockwise about a tilt shaft 13*a*. In the outboard motor 1, fins 10*c* are located below the water surface in the posture of FIG. 1.

The outboard motor 1 includes an engine 7, a driving shaft 8, a gear mechanism 9, and a propeller mechanism 10, which are accommodated inside an upper cover 2 or a lower cover 3. The outboard motor 1 includes, below the engine 7, an exhaust system (not illustrated) that causes exhaust gas of the engine 7 to flow, and a cooling structure 6 that cools the engine 7 and the exhaust gas.

The cooling structure 6 is configured by, for example, stacking a plurality of cases inside the lower cover 3. The cooling structure 6 may include a silencing function. The silencing function is realized by causing cooling water (sea water or fresh water that has been taken in from the outside of the outboard motor 1) to flow around an exhaust pipe (not illustrated) of the exhaust gas.

The engine 7 is a multiple cylinder engine of taking in natural air (for example, a V-type engine) including a plurality of cylinders 73 along the up-and-down direction of the outboard motor 1. The engine 7 has a structure in which the axis of each cylinder 73 is disposed transversely (substantially horizontal). The piston of each cylinder 73 and the crankshaft 74 are coupled by a connecting rod 75, and the crankshaft 74 extends in the up-and-down direction. A water jacket is formed in a cylinder block 72 and a cylinder head 71 of the engine 7, and these components can be cooled with use of the cooling water of the cooling structure 6.

The crankshaft 74 is coupled with an upper end of the driving shaft 8. The driving shaft 8 extends in the up-and-down direction, and rotates in accordance with the rotation of the crankshaft 74. The lower end of the driving shaft 8 enters the gear mechanism 9. The gear mechanism 9 switches the driving force of the engine 7 in accordance with an operation of an operation shaft 11 to rotate the propeller mechanism 10 so as to move the hull Sh forward or backward. The operation shaft 11 is rotated by, for example, a shift actuator 11*a* to be driven in accordance with a shift operation by the user.

The gear mechanism 9 moves a shift slider 12 forward and backward in the axial direction of a propeller shaft 10*a* in accordance with the rotation of the operation shaft 11. Accordingly, the shift slider 12 moves a dog clutch 9*d* between a forward driven bevel gear 9*b* and a backward driven bevel gear 9*c*, which are engaged with a driving bevel gear 9*a* coupled with the driving shaft 8. Then, the tooth surface of the dog clutch 9*d* meshes with either one of an inner tooth surface of the forward driven bevel gear 9*b* or an inner tooth surface of the backward driven bevel gear 9*c*, so that the driving force of the engine 7 transmits through the dog clutch 9*d* and the propeller shaft 10*a* to the propeller mechanism 10.

The propeller mechanism 10 includes the cylindrical propeller shaft 10*a*, into which the shift slider 12 is inserted, a cylindrical body 10*b* coupled with a radially outer side of the propeller shaft 10*a*, and a plurality of fins 10*c* coupled with an outer circumferential surface of the cylindrical body 10*b*. The propeller mechanism 10 rotates each fin 10*c* clockwise or counterclockwise about the propeller shaft 10*a* as the rotation center, which is rotated by the gear mechanism 9, so as to move the hull Sh forward or backward.

The upper cover 2 mainly covers the engine 7 located at an upper part of the outboard motor 1, and the lower cover 3 mainly covers the configuration below the engine 7. The upper cover 2 and the lower cover 3 are fixed to, for example, a mount frame (not illustrated) on which the engine 7 is mounted, and are divided with the mount frame as a boundary.

Figure 2:
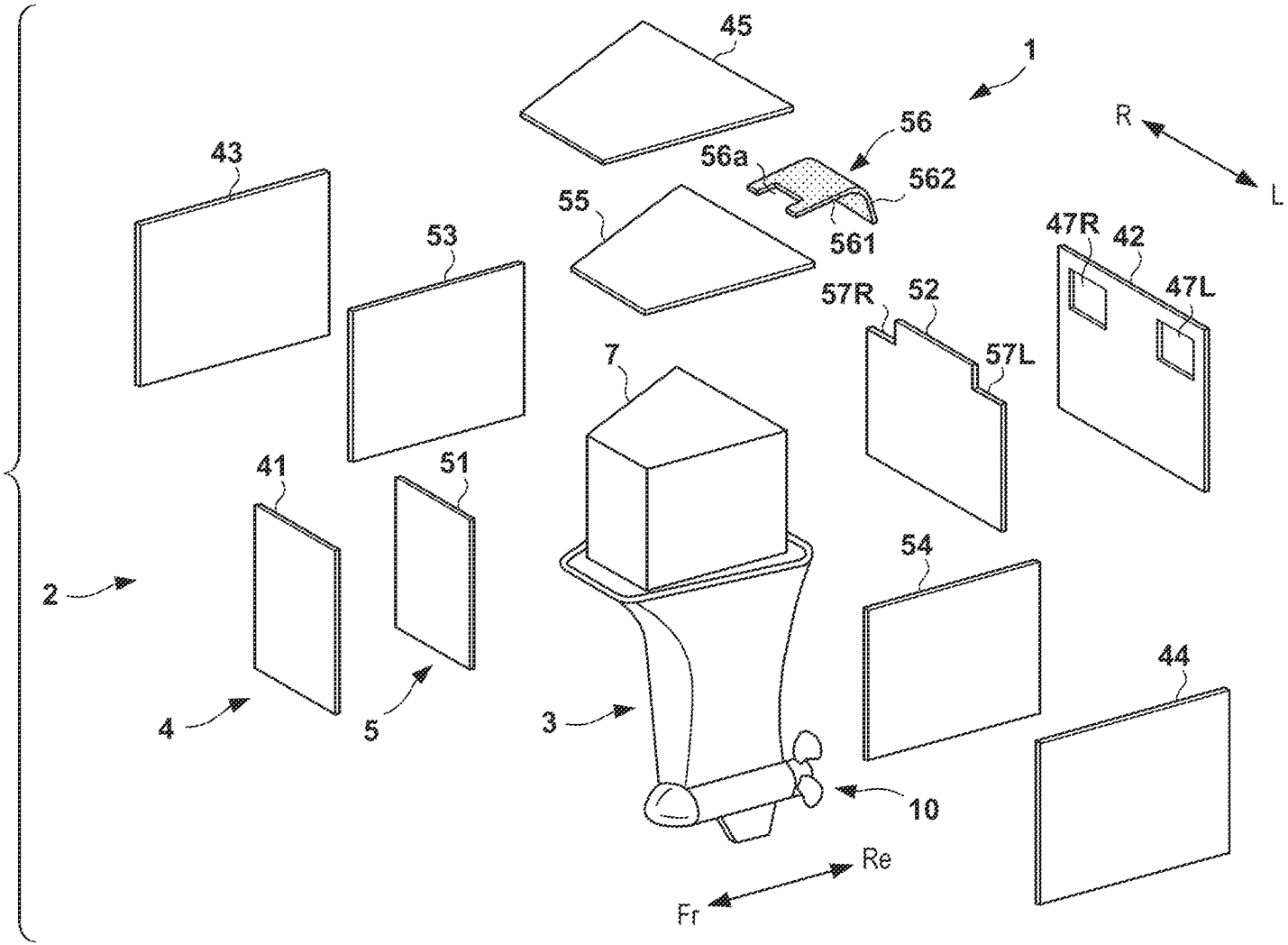
FIG. 2 is an exploded perspective view schematically illustrating constituent elements of an upper cover.

The upper cover 2 is a hollow body for covering front, rear, left, right, upper, and lower sides of the engine 7, and has a double structure overlapping each other and including an outer cover 4 on the outer side and an inner cover 5 disposed inside the outer cover 4. The outer cover 4 has a divided structure including a plurality of members, and the inner cover 5 also has a divided structure including a plurality of members. The outer cover 4 forms an outer wall of the outboard motor 1. FIG. 2 is an exploded perspective view schematically illustrating each configuration of the outer cover 4 and the inner cover 5. In the present embodiment, the outer cover 4 and the inner cover 5 each constitute a hollow body that covers the engine 7.

Note that in the present embodiment, the outer cover 4 and the inner cover 5 are each a divided-type cover made up of a plurality of members. However, at least one of the outer cover 4 and the inner cover 5 may be an integrated-type cover made up of a single member.

The outer cover 4 is configured by combining an outer front surface portion 41, an outer rear surface portion 42, an outer right side surface portion 43, an outer left side surface portion 44, and an outer upper surface portion 45, and each portion is made up of a panel-shaped cover member. The outer front surface portion 41 covers the front surface of the engine 7, and the outer rear surface portion 42 covers the rear surface of the engine 7. The outer right side surface portion 43 covers the right side surface of the engine 7, and the outer left side surface portion 44 covers the left side surface of the engine 7. The outer upper surface portion 45 covers the upper surface portion of the engine 7.

Among edge portions of the outer front surface portion 41, the outer rear surface portion 42, the outer right side surface portion 43, the outer left side surface portion 44, and the outer upper surface portion 45, the edge portions adjacent to each other are detachably joined by a fixing structure, not illustrated, such as an engagement structure or a fastening structure of screwing or the like.

The inner cover 5 is configured by combining an inner front surface portion 51, an inner rear surface portion 52, an inner right side surface portion 53, an inner left side surface portion 54, and an inner upper surface portion 55, and each portion is made up of a panel-shaped cover member. The inner front surface portion 51 is located between the outer front surface portion 41 and the front surface of the engine 7, and covers the front surface of the engine 7. The inner rear surface portion 52 is located between the outer rear surface portion 42 and the rear surface of the engine 7, and covers the rear surface of the engine 7. The inner right side surface portion 53 is located between the outer right side surface portion 43 and the right side surface of the engine 7, and covers the right side surface of the engine 7. The inner left side surface portion 54 is located between the outer left side surface portion 44 and the left side surface portion of the engine 7, and covers the left side surface portion of the engine 7. The inner upper surface portion 55 is located between the outer upper surface portion 45 and the upper surface portion of the engine 7, and covers the upper surface portion of the engine 7.

Among edge portions of the inner front surface portion 51, the inner rear surface portion 52, the inner right side surface portion 53, the inner left side surface portion 54, and the inner upper surface portion 55, the edge portions adjacent to each other are detachably joined by a fixing structure, not illustrated, such as an engagement structure or a fastening structure of screwing or the like.

Intake ports 47R and 47L for taking in the air (outside air) are formed in the outer rear surface portion 42. In addition, intake ports 57R and 57L for taking in the air are formed in the inner rear surface portion 52. The air for combustion (the air for intake) is supplied to the engine 7 through the intake ports 47R and 47L and the intake ports 57R and 57L. An air intake passage is formed between the outer cover 4 and the inner cover 5. The air intake passage is mainly formed with the inner upper surface portion 55, the inner rear surface portion 52, the outer rear surface portion 42, and a passage formation member 56. Hereinafter, the structure of the air intake passage will be described in detail.

<Air Intake Passage Structure>

The engine 7 is used on water, and therefore the intake air may contain water droplets. The water droplets cause performance degradation and deterioration of the engine. The air intake passage structure in the present embodiment has a structure for separating moisture in the intake air with more certainty. The air intake passage structure will be described with reference to FIGS. 2 to 7. Airflows D1 to D9 indicated in FIGS. 3 to 7 respectively correspond to themselves in the drawings.

Figure 3:
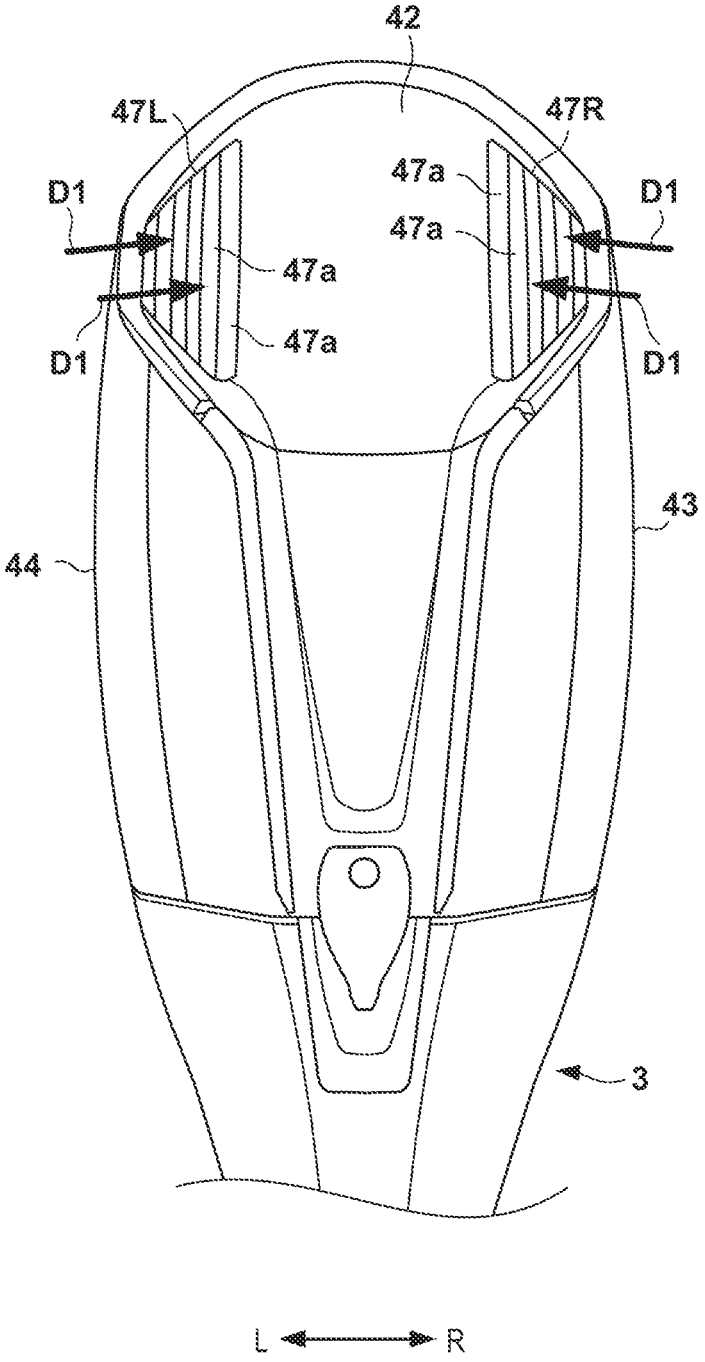
FIG. 3 is a rear view of the outboard motor of FIG. 1.

FIG. 3 is a rear view of the outboard motor 1. The intake ports 47R and 47L are formed to be separated from each other to the right and the left in an upper part of the outer rear surface portion 42, and the outside air flows into the outboard motor 1 as indicated by the airflow D1.

The intake ports 47R and 47L are formed at the rear part of the outboard motor 1, so that traveling wind that may contain a large amount of moisture or splashes around the outboard motor 1 cannot enter the intake ports 47R and 47L easily. The intake ports 47R and 47L are formed at the upper part of the outboard motor 1, and the intake ports 47R and 47L are spaced apart from the water surface, so that the splashes around the outboard motor 1 cannot enter the intake ports 47R and 47L easily. The intake ports 47R and 47L are formed to be separated from each other to the right and the left, so that the air necessary for the engine 7 can be sufficiently taken in.

In the present embodiment, the intake ports 47R and 47L each have a louver having a plurality of slats 47*a*. The splashes around the outboard motor 1 cannot enter the inside of the outer cover 4 easily from the intake ports 47R and 47L.

Figure 4:
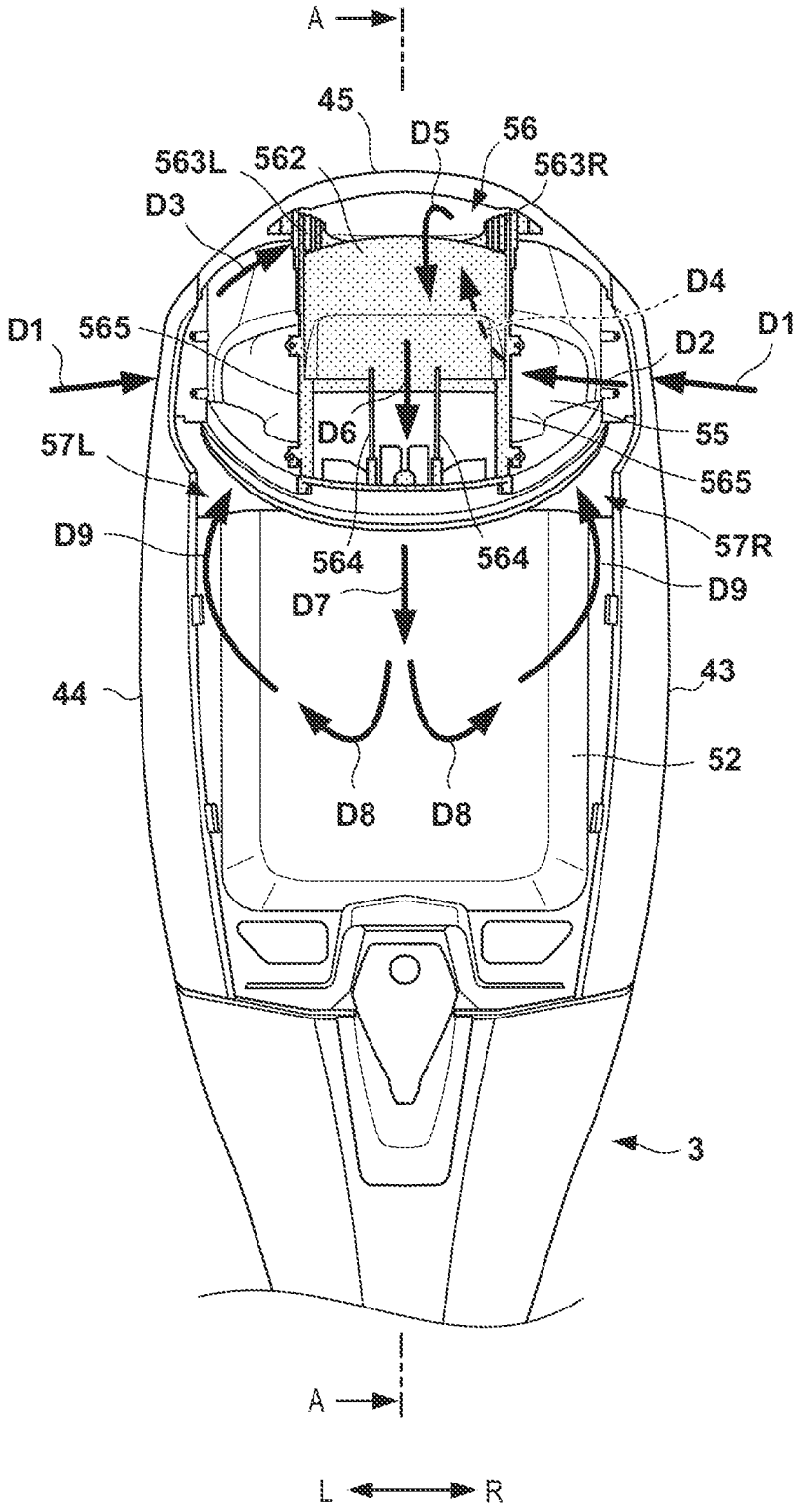
FIG. 4 is a rear view of the outboard motor of FIG. 1 in which an outer rear surface portion is removed.
Figure 5:
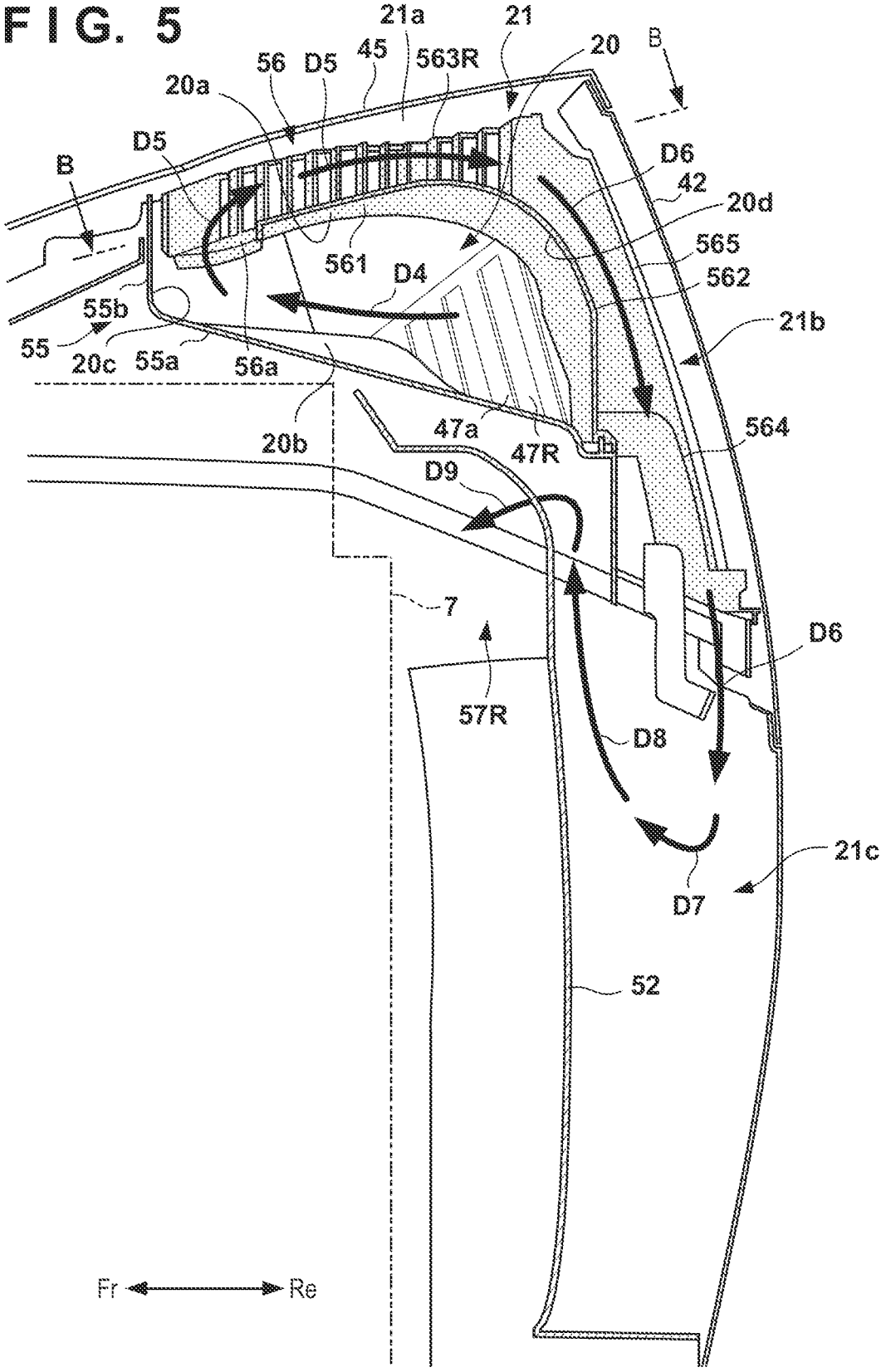
FIG. 5 is a cross-sectional view taken along line A-A of FIG. 4.
Figure 6:
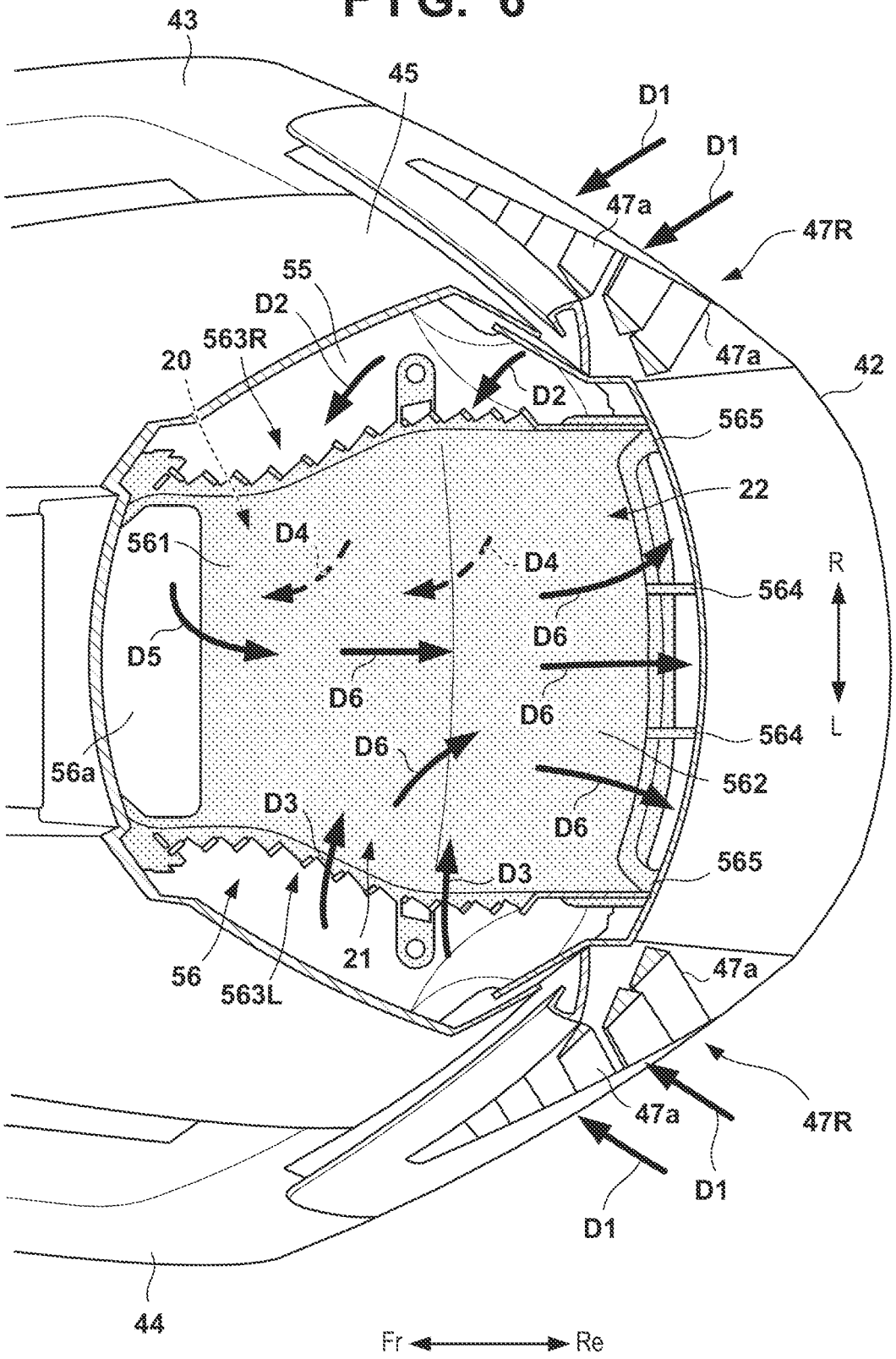
FIG. 6 is a cross-sectional view taken along line B-B of FIG. 5.

FIG. 4 is a rear view of the outboard motor 1, from which the outer rear surface portion 42 is removed. FIG. 5 is a cross-sectional view taken along line A-A of FIG. 4, and FIG. 6 is a cross-sectional view taken along line B-B of FIG. 5.

At the rear part of the outboard motor 1, an air introduction chamber 20 is formed with the passage formation member 56 between the outer cover 4 and the inner cover 5. In addition, an air passage 21 is formed inside the outer cover 4.

The air introduction chamber 20 is disposed in a rear part of the outboard motor 1. A top portion 20*a*, a bottom portion 20*b*, a front end portion 20*c*, and a rear end portion 20*d* of the air introduction chamber 20 are closed, and the left side and the right side are opened. The top portion 20*a* and the rear end portion 20*d* are respectively defined by partition walls 561 and 562 of the passage formation member 56. The bottom portion 20*b* and the front end portion 20*c* are respectively defined by wall portions 55*a* and 55*b* of the inner upper surface portion 55. The wall portion 55*a* forming the bottom portion 20*b* is inclined downward with respect to the horizontal direction from the front side to the rear side in the front-and-rear direction of the outboard motor 1.

A right side portion of the air introduction chamber 20 communicates with the intake port 47R, and a left side portion of the air introduction chamber 20 communicates with the intake port 47L. Therefore, the air that has flown in from the intake ports 47R and 47L flows into the air introduction chamber 20 from the left and right side portions of the air introduction chamber 20, as indicated by the airflow D2, in accordance with negative pressure generated by the engine 7.

The air passage 21 includes passage parts 21*a* to 21*c*, and is a passage for guiding the air from the air introduction chamber 20 to the intake ports 57R and 57L. The air passage 21 is adjacent to the air introduction chamber 20 via the partition walls 561 and 562 respectively in the passage parts 21*a* and 21*b*.

The passage part 21*a* is located above the air introduction chamber 20, and is mainly formed between the partition wall 561 of the passage formation member 56 and the outer upper surface portion 45. The partition wall 561 extends in the front-and-rear direction and a left-and-right direction of the outboard motor 1, and is inclined upward from the front side to the rear side. Therefore, the passage part 21*a* is also a passage inclined slightly upward from the front side to the rear side. An opening 56*a* is formed in a front part of the partition wall 561, and the air introduction chamber 20 and the passage part 21*a* communicate with each other through the opening 56*a*. As indicated by the airflows D4 and D5, the air that has flown into the air introduction chamber 20 flows through the opening 56*a* into the passage part 21*a* in accordance with the negative pressure generated by the engine 7, and flows rearward.

The passage part 21*b* is located on the rear side of the air introduction chamber 20, and extends downward from a rear end portion of the passage part 21*a*. The passage part 21*b* is mainly formed between the partition wall 562 of the passage formation member 56 and the outer rear surface portion 42. The partition wall 562 is continuous from the partition wall 561 through a smooth curved portion, and extends in the up-and-down direction and the left-and-right direction. The air that has flown into the passage part 21*a* flows downward in the passage part 21*b*, as indicated by the airflow D6, in accordance with the negative pressure generated by the engine 7. The partition wall 562 is integrally formed with a plurality of plate-shaped ribs 564 (two ribs in the present embodiment) extending in the passage direction (downward in the present embodiment) of the passage part 21*b* and protruding from the partition wall 562 toward the inner surface of the outer rear surface portion 42. The air indicated by the airflow D6 is guided downward while being straightened by the ribs 564. Further, the provision of the ribs 564 enables an improvement in the rigidity of the passage formation member 56 against the pressure of the airflow.

Figure 7:
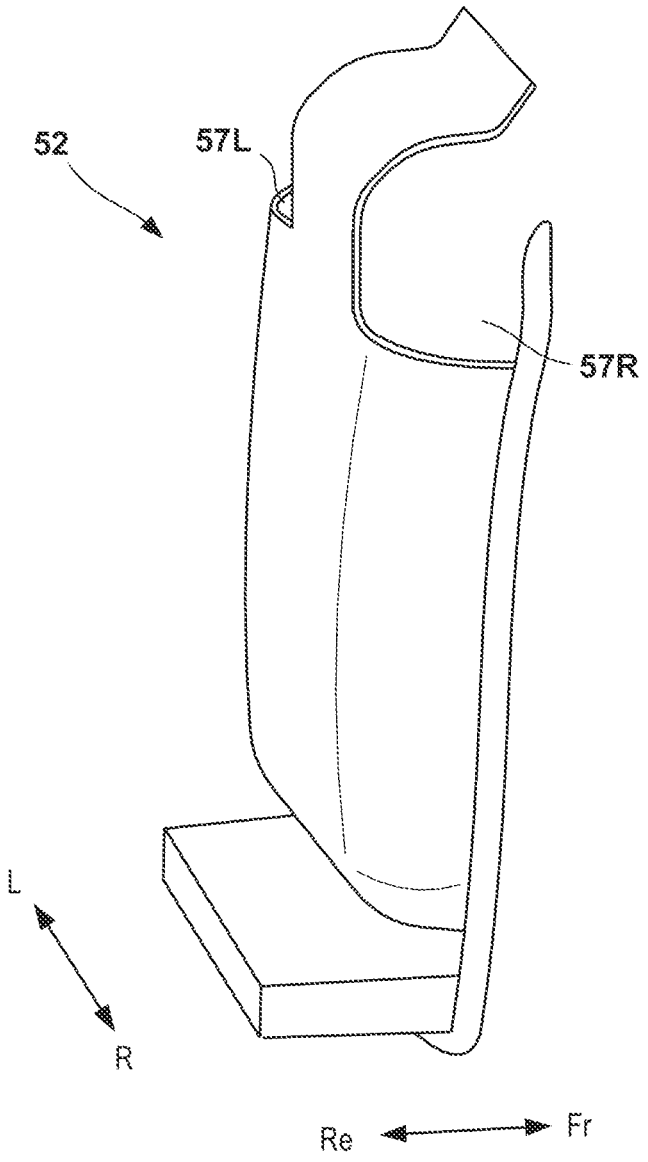
FIG. 7 is a perspective view of an inner rear surface portion.

The passage part 21*c* is located below the passage part 21*b*, and is mainly formed between the inner rear surface portion 52 and the outer rear surface portion 42. FIG. 7 is a perspective view of the cover member constituting the inner rear surface portion 52. The inner rear surface portion 52, as a whole, has a box shape bulging outward on the rear side of the outboard motor 1 and opening on the front side (engine 7 side), and the intake ports 57R and 57L are respectively formed on the right and left in an upper part thereof. The intake ports 57R and 57L are located below the air introduction chamber 20. The descending airflow D6 that has flown into the passage part 21*c* is converted into ascending airflow as indicated by the airflows D7 and D8 in accordance with the negative pressure generated by the engine 7, and flows into the inner cover 5 from the intake port 57R or 57L as indicated by the airflow D9. Then, the air is supplied to an air intake system of the engine 7.

Louver portions 563R and 563L extending in the front-and-rear direction of the outboard motor 1 are respectively formed on the right and left end sides of the partition wall 561 of the passage formation member 56. The louver portion 563R communicates with the intake port 47R, and the louver portion 563L communicates with the intake port 47L. The air that has flown in from the intake ports 47R and 47L are also capable of flowing into the passage part 21*a* respectively from the louver portions 563R and 563L without passing through the air introduction chamber 20 as indicated by the airflow D3 in accordance with the negative pressure generated by the engine 7.

The louver portions 563R and 563L respectively include opening areas smaller than right and left side portions of the air introduction chamber 20, and most of the air that has flown in from the intake ports 47R and 47L flows into the air introduction chamber 20. However, when the air intake amount of the engine 7 increases, for example, when an output from the engine 7 becomes high, the outside air can also be supplied to the engine 7 from the louver portions 563R and 563L, and an increase in the air intake amount can be handled.

Next, a function of removing the moisture in the air will be described. As indicated by the airflows D1 and D2, the air that has flown into the outer cover 4 from the intake ports 47R and 47L respectively enters the air introduction chamber 20 or the louver portions 563R and 563L.

The air that has entered the air introduction chamber 20 flows forward in the front-and-rear direction of the outboard motor 1 as indicated by the airflows D4 and D5, ascends through the opening 56*a*, and enters the passage part 21*a*. By generating the ascending airflow, it becomes possible to conduct air-liquid separation in the air introduction chamber 20. That is, the air introduction chamber 20 functions as an air-liquid separation chamber. In addition, the opening 56*a* is formed on the front side of the top portion 20*a*, so that a forward movement amount of the air that has entered the air introduction chamber 20 can be further increased, and the air-liquid separation effect of the air in such a section can be improved. Furthermore, the wall portion 55*a* that forms the bottom portion 20*b* is inclined downward with respect to the horizontal direction from the front side to the rear side, in the front-and-rear direction of the outboard motor 1. This configuration encourages the air that has entered the air introduction chamber 20 to flow forward and upward. Therefore, the air-liquid separation can be further promoted. Further, the separated moisture flows rearward and downward due to the inclination of the wall portion 55*a*, and is discharged to the outside of the outboard motor 1 through a discharge hole, not illustrated, without entering the inner cover 5.

In addition, the air that has entered the louver portions 563R and 563L comes into contact with slats of the respective louver portions 563R and 563L, the air-liquid separation is conducted, and the air enters the passage part 21*a*.

The air that has entered the passage part 21*a* becomes descending airflow in the passage part 21*b* as indicated by the airflow D6, and turns into ascending airflow as indicated by the airflows D7 and D8 in the passage part 21*c*. By turning into the ascending airflow, the moisture in the air is also separated here. The separated moisture flows toward the bottom portion of the passage part 21*c*, and is discharged to the outside of the outboard motor 1 through a discharge hole, not illustrated, without entering the inner cover 5.

As described heretofore, in the present embodiment, it is possible to sufficiently remove the moisture, in the process in which the air flows from the intake ports 47R and 47L of the outer rear surface portion 42 to the intake ports 57R and 57L of the inner rear surface portion 52, and to supply the air to the engine 7. There are areas where the airflow becomes the ascending airflow in the opening 56*a*, the passage part 21*c*, and the like, so that the moisture can be sufficiently removed even when the flow velocity of intake air is fast. In particular, as the flow velocity of the intake air becomes faster, the moisture is separated more easily from the air by inertial force in the areas where the ascending airflow is generated, so that the removal performance for removing the moisture can be improved.

SUMMARY OF EMBODIMENTS

The above-described embodiments disclose at least an air intake passage structure as follows.

1. An air intake passage structure in the above embodiments includes:

an outer cover (4) forming an outer wall of an outboard motor (1);

an inner cover (5) disposed inside the outer cover, and covering an engine (7) of the outboard motor;

a first intake port (47R, 47L) formed in the outer cover;

a second intake port (57R, 57L) formed in the inner cover, air being supplied to the engine via the first intake port and the second intake port;

an air introduction chamber (20) formed between the outer cover and the inner cover, and communicating with the first intake port; and an air passage (21) formed inside the outer cover, and guiding the air from the air introduction chamber to the second intake port, wherein the air passage is adjacent to the air introduction chamber via a partition wall (561, 562), the air passage includes:

a first passage part (21*a*) on an upper side of the air introduction chamber; and a second passage part (21*b*) extending downward from the first passage part, and the air introduction chamber includes:

a side portion communicating with the first intake port; and a top portion (20*a*) communicating with the first passage part through an opening (56*a*) formed in the partition wall.

According to this embodiment, it is possible to provide the air intake passage structure capable of more reliably separating the moisture in the intake air. The ascending airflow is generated in the opening, so that the air-liquid separation can be promoted.

2. The air intake passage structure in the above embodiments, further includes a passage formation member (56) including the partition wall, in which the first passage part and the second passage part are formed between the passage formation member and the outer cover (4,42), and the passage formation member includes a louver portion (563R, 563L) that communicates a side portion of the first passage part with the first intake port.

According to this embodiment, the air-liquid separation can be conducted, when the air passes through the louver portion, while an increase in the air intake amount is handled by allowing a shortcut of the airflow to pass through the louver portion.

3. In the air intake passage structure in the above embodiments, the first intake port includes a left-side intake port (47L) and a right-side intake port (47R), and the air introduction chamber includes a left-side portion communicating with the left-side intake port and a right-side portion communicating with the right-side intake port, and the louver portion includes a left-side louver portion (563L) communicating with the left-side intake port and a right-side louver portion (563R) communicating with the right-side intake port.

According to this embodiment, the outside air can be taken in from the left and the right of the outboard motor, and an increase in the air intake amount can be handled.

4. In the air intake passage structure in the above embodiments, the passage formation member includes a rib (564) extending in a passage direction of the second passage part, and protruding toward an inner surface of the outer cover.

According to this embodiment, the rigidity of the passage formation member can be improved, while the airflow is being straightened.

5. In the air intake passage structure in the above embodiments, the inner cover includes a wall portion (55*a*) that forms a bottom portion of the air introduction chamber, and the wall portion is inclined with respect to a horizontal direction.

According to this embodiment, the moisture that has been separated from the air in the air introduction chamber can be collected and easily discharged.

6. In the air intake passage structure in the above embodiments, the second intake port is located below the air introduction chamber, and includes a left-side intake port (57L) and a right-side intake port (57R).

According to this embodiment, the two intake ports are provided, so that resistance to the intake airflow can be reduced. In addition, the air-liquid separation can be promoted by generating the ascending airflow in a process in which the air flows from the air introduction chamber to the intake port.

7. In the air intake passage structure in the above embodiments, the air introduction chamber and the first intake port are disposed in a rear part of the outboard motor in a front-and-rear direction of the outboard motor, the second passage part is disposed on a rear side of the air introduction chamber in the front-and-rear direction, and the opening is formed on a front side of the top portion in the front-and-rear direction.

According to this embodiment, it cannot be easily influenced by the traveling wind containing the moisture. In addition, the air-liquid separation section for the air in the air introduction chamber can be made longer.

The invention is not limited to the foregoing embodiments, and various variations/changes are possible within the spirit of the invention.

What is claimed is:

1. An air intake passage structure comprising:

an outer cover forming an outer wall of an outboard motor;

an inner cover disposed inside the outer cover, and covering an engine of the outboard motor;

a first intake port formed in the outer cover;

a second intake port formed in the inner cover, air being supplied to the engine via the first intake port and the second intake port;

an air introduction chamber formed between the outer cover and the inner cover, and communicating with the first intake port; and an air passage formed inside the outer cover, and guiding the air from the air introduction chamber to the second intake port, wherein the air passage is adjacent to the air introduction chamber via a partition wall, the air passage includes:

a first passage part on an upper side of the air introduction chamber; and a second passage part extending downward from the first passage part, and the air introduction chamber includes:

a side portion communicating with the first intake port; and a top portion communicating with the first passage part through an opening formed in the partition wall.

2. The air intake passage structure according to claim 1, further comprising a passage formation member including the partition wall, wherein the first passage part and the second passage part are formed between the passage formation member and the outer cover, and the passage formation member includes a louver portion that communicates a side portion of the first passage part with the first intake port.

3. The air intake passage structure according to claim 2, wherein the first intake port includes a left-side intake port and a right-side intake port, and the air introduction chamber includes a left-side portion communicating with the left-side intake port and a right-side portion communicating with the right-side intake port, and the louver portion includes a left-side louver portion communicating with the left-side intake port and a right-side louver portion communicating with the right-side intake port.

4. The air intake passage structure according to claim 2, wherein the passage formation member includes a rib extending in a passage direction of the second passage part, and protruding toward an inner surface of the outer cover.

5. The air intake passage structure according to claim 1, wherein the inner cover includes a wall portion that forms a bottom portion of the air introduction chamber, and the wall portion is inclined with respect to a horizontal direction.

6. The air intake passage structure according to claim 1, wherein the second intake port is located below the air introduction chamber, and includes a left-side intake port and a right-side intake port.

7. The air intake passage structure according to claim 1, wherein the air introduction chamber and the first intake port are disposed in a rear part of the outboard motor in a front-and-rear direction of the outboard motor, the second passage part is disposed on a rear side of the air introduction chamber in the front-and-rear direction, and the opening is formed on a front side of the top portion in the front-and-rear direction.

8. The air intake passage structure according to claim 1, wherein the second intake port is covered by the outer cover, and is located lower than the air introduction chamber.

* * * * *